United States Patent [19]

Helms et al.

[11] 4,359,169

[45] Nov. 16, 1982

[54] CONTAINER END CLOSURE ARRANGEMENT

[75] Inventors: Charles R. Helms, Malvern; Richard L. Bell, Exton, both of Pa.

[73] Assignee: Container Corporation of America, Chicago, Ill.

[21] Appl. No.: 297,247

[22] Filed: Aug. 28, 1981

[51] Int. Cl.[3] ..... B65D 51/22; B65D 41/00

[52] U.S. Cl. ..... 220/258; 220/257; 220/359; 229/43

[58] Field of Search ..... 220/257, 258, 256, 359, 220/270; 229/43, 5.5, 5.6, 5.7; 215/232

[56] References Cited

U.S. PATENT DOCUMENTS

| | | | |
|---|---|---|---|
| 3,973,719 | 8/1976 | Johnson et al. | 220/359 |
| 4,171,084 | 10/1979 | Smith | 229/43 |
| 4,209,126 | 6/1980 | Elias | 220/359 |
| 4,280,653 | 7/1981 | Elias | 229/43 |

*Primary Examiner*—George T. Hall

*Attorney, Agent, or Firm*—Richard W. Carpenter; Davis Chin

[57] ABSTRACT

An end closure arrangement for a tubular container including a metallic foil membrane having a heat sealable coating on both sides thereof bonding said membrane between adjacent container and end closure rim surfaces.

8 Claims, 8 Drawing Figures

CONTAINER END CLOSURE ARRANGEMENT

BACKGROUND OF THE INVENTION

1. Field of the Invention

This invention relates to closure arrangements, and more particularly to a closure arrangement which includes container body and end members having plastic rim portions which are bonded to each other by a membrane interposed therebetween.

2. Description of the Prior Art

A prior art search directed to the subject matter of this application in the United States Patent and Trademark Office revealed the following United States Pat. Nos.: 2,200,200; 2,241,710; 2,620,939; 3,089,609; 3,301,464; 3,419,181; 3,445,027; 3,815,314; 3,892,351; 4,000,816; 4,094,460; 4,171,084; 4,215,797; 4,243,152.

None of the prior art patents uncovered in the search discloses a closure arrangement wherein a membrane comprising a metallic foil central panel, having heat activatable coatings on both sides thereof, is sandwiched between and used to bond the corresponding rim portions of container body and end members to each other.

SUMMARY OF THE INVENTION

This invention relates generally to containers and particularly containers of a tubular type having body and end members with plastic rims.

The invention is concerned with a means of securing the rim portions of container end and body members to each other.

It is a primary object of the invention to utilize a membrane for the dual purpose of providing a hermetic seal for the container and also for bonding the rims of container body and end members to each other.

A more specific object of the invention is a provision of a membrane comprising a central metallic foil panel coated on both sides with a heat activatable materials, such as plastic, which serves to bond the membrane member to both the container body and the container end.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENTS

Figure 1:
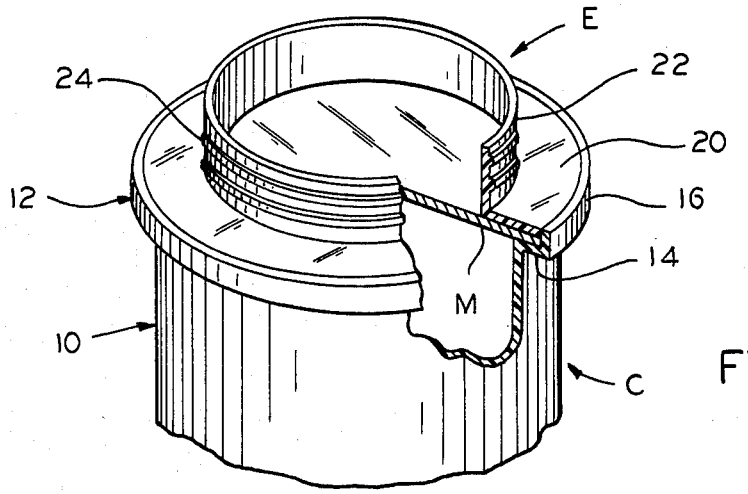
FIG. 1 is a fragmentary perspective view of a container body member and end closure member, embodying features of the invention.
Figures 3, 4, 5:
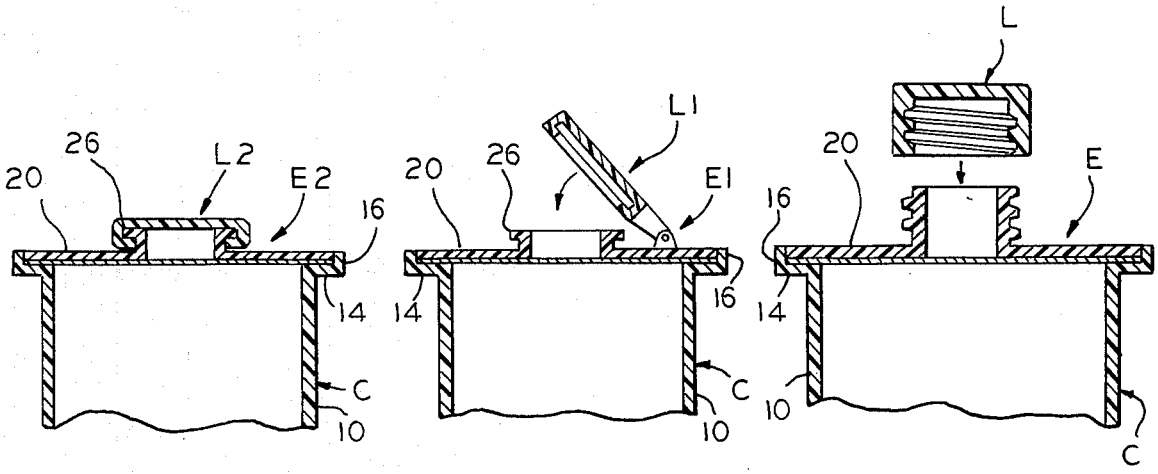
FIG. 3 is a view similar to that of FIG. 2 but illustrating the application of a separate cap to the end closure member.
FIGS. 4 and 5 are views similar to FIG. 3 but illustrate alternate forms of cap arrangements.

Referring now to the drawings for a better understanding of the invention, and particularly to FIGS. 1 and 3, it will be seen that there is provided a generally cylindrical container member, indicated generally at C, to which is secured an end member, indicated generally at E. End member E may include a separate overcap or lid, indicated generally at L.

The end member is secured to the container member by means membrane, indicated generally at M, which is described in greater detail hereinafter.

Container C may either be of all plastic or a combination of paperboard and plastic materials. In either case it has a plastic rim 12 formed at the upper or open end of a side wall 10.

Container rim 12 includes a radially outward extending, annular, horizontal flange 14 having an annular vertical flange 16 extending axially outward from its outer edge to form, with horizontal flange 14, a recess 17 for receipt of a rim portion of end closure member E.

It will be seen that end closure member E includes an annular rim portion, preferably formed of plastic, which has an annular, horizontal element 20 and integral, annular, vertical element 22 extending axially outward from the inner edge thereof Vertical element 22 may be provided with external threads 24 to accommodate a screw-on overcap L, as indicated in FIG. 3.

As an alternative to the screw cap arrangement vertical element 22 may be provided at its adjacent free edge with an annular flange 22 adapted to accommodate either the hinged lid L1, as shown in FIG. 4, or a snap-on lid L2, as illustrated in FIG. 5. The type of overcap is immaterial to the invention, because the invention in this case relates primarily to the manner in which the rim portion of the end member is attached to the rim portion of the container body member.

Figure 2:
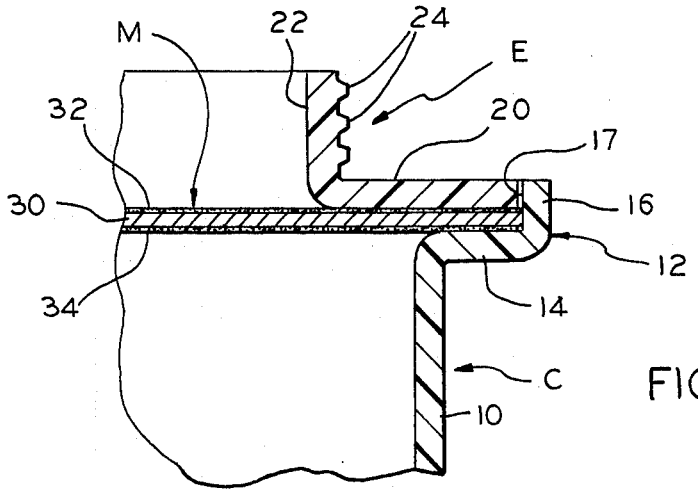
FIG. 2 is a fragmentary vertical cross section of a portion of the structure illustrated in FIG. 1.

As best seen in FIG. 2, this attachment is accomplished by means of a relatively flat preferably arcuate membrane, indicated generally at M.

Membrane M includes a central panel or core 30 which is a thin layer of metallic foil. Central panel 30 is coated on both sides with heat activatable sealing materials such as polyethylene, polypropylene, or some simlar type of material. The coating on the outer surface is indicated at 32, and the coating on the inner surface is indicated at 34.

Still referring to FIG. 2, it will be seen that outer coating 32 comes in direct contact with the inwardly facing surface of the end member rim portion horizontal element 20, and inner coating 34 before it comes in contact with the outwardly facing surface of container body rim horizontal flange 14.

In order to effect a seal between the container end and body members the membrane is placed in position therebetween and heat is generated, through induction currents, which pass through the central foil portion of the membrane. The heat activates the adhesive compositions 32 and 34 causing a container body closure members to be bonded together and to effect a hermetic seal therebetween.

In order to have access to the interior of the container to dispense contents therefrom, after the overcap is removed, the membrane may be cut with a knife or pierced with some sharp object.

Figure 6:
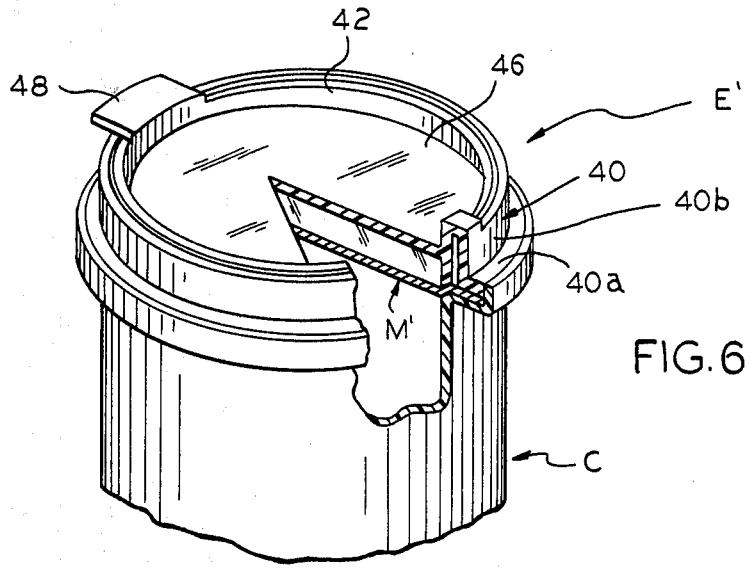
FIGS. 6 and 7 are views similar to FIGS. 1 and 2, respectively, but illustrate a modified form of the invention.
Figure 7:
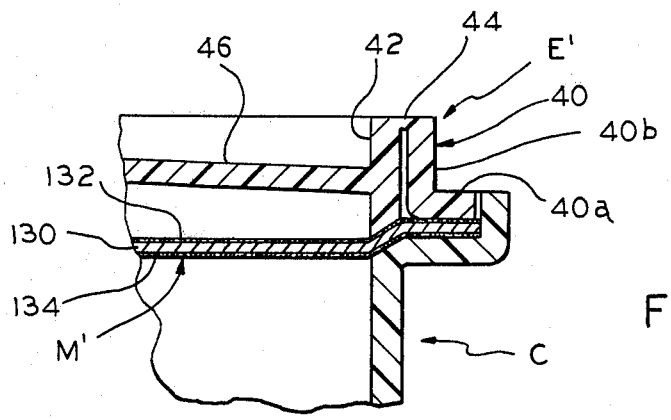
Figure 8:
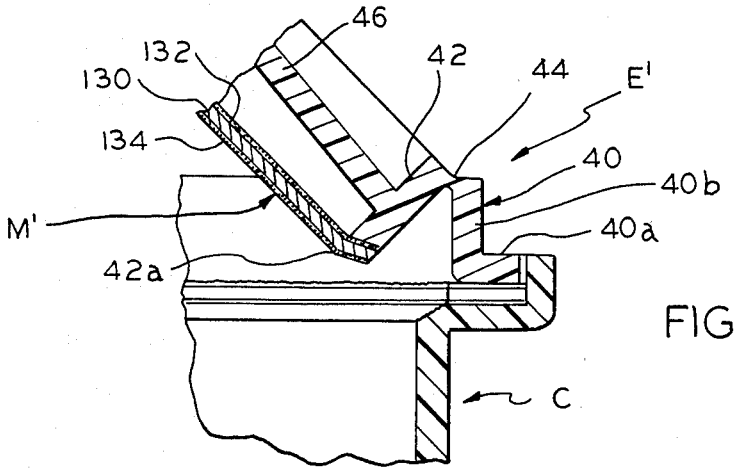
FIG. 8 is a view similar to FIG. 7 but illustrating the closure arrangement with the removable portion of the closure shown in an open position.

Referring now to FIGS. 6 through 8, it will be seen that a slightly modified form of the invention is shown.

In this embodiment container C is substantially identical in construction to the container illustrated in the previously described embodiment. Membrane M′ is similar to the membrane of the previous embodiment but slightly different as will be described hereinafter. The primary difference in the two embodiments, lies in the end closure member E′ which includes a movable portion as hereinafter described.

As best seen in FIGS. 7 and 8, end closure member E′ includes a preferably plastic outer rim portion indicated generally at 40 and an inner rim portion indicated generally at 42 which are hingedly attached at one location on their upper edges by a relatively narrow, thin web of plastic 44 which serves as a hinge.

Cylindrical outer rim portion 40 is generally L-shaped as seen in cross-section and includes a horizontal portion 40*a* adapted to be received within recess 17 of the rim of the container C and an axially outward extending vertical portion 40*b* formed integrally therewith.

Concentric, cylindrical inner rim portion 42 encloses and is secured to or formed integrally with a central panel 46, which may be formed of plastic or paperboard, as desired. As best seen in FIG. 8, the inner portion of the closure member E′, because of its hinge relation to the outer portion, can be pivoted when lifted by the lift tab 48, at the opposite side of the closure member, and can be moved away from the container to provide an access to provide an access to the interior container.

As in the case of the previous embodiment the outer rim portion 40 of the end closure member E′ is bonded to the horizontal flange rim of the container member C by means of a membrane indicated generally at M′.

Membrane M′ includes a metallic foil central panel, indicated at 130, having a heat-activatable coating 132 on its outer surface and a heat activatable coating 134 on its inner surface.

The only differences between the membrane arrangement of this embodiment and that of the previously described embodiment is that the membrane of FIG. 7, instead of lying in a single plane as in the case of the earlier described embodiment, is offset, with a portion being disposed in an angle between part of the rim of the container and the sloping surface 42*a* of end closure member inner rim portion 42. Also the composition of the heat activatable material 132 which secures the membrane to the end closure member is such that it forms a stronger bond than the bond formed between coating 134 on the inner surface of the membrane and the related surface of the container rim. The purpose of this is to permit the membrane to have its central portion detached from its peripheral portion, as shown in FIG. 8, and also to remain adhered to the movable portion of the end member when it is separated from the adjacent portion of the container member as shown in FIG. 8 to permit the container end member, so it can be pivoted away from the container to afford access to the contents of the container.

Thus, it will be appreciated that in each of the embodiments of the invention there is provided a novel means to utilize a coated metallic foil membrane as both a hermetic seal and means of bonding a container closure member to a container body member.

What is claimed is:

1. In a closure arrangement for a container having body and closure members with plastic rim portions, the combination of:

(a) a tubular container member including a rim presenting a relatively flat, annular, axially outward facing, sealing surface;

(b) a closure member including a rim presenting a relatively flat, annular, axially inward facing, sealing surface;

(c) a relatively flat sealing membrane secured between said members and comprising:

(i) a central panel formed of a relatively thin metallic foil;

(ii) a heat activatable coating of plastic material on the inner surface of said central panel bonding said membrane to said container rim surface;

(iii) a heat activatable coating of plastic material on the outer surface of said central panel bonding said membrane to said closure member rim surface.

2. A closure arrangement according to claim 1, wherein said membrane is disposed substantially entirely in one plane.

3. A closure arrangement according to claim 1, wherein said membrane is disposed in more than one plane.

4. A closure arrangement according to claim 1, wherein said closure member includes a snap-on lid.

5. A closure arrangement according to claim 1, wherein said closure member includes a hinged lid.

6. A closure arrangement according to claim 1, wherein said closure member includes a screw-on lid.

7. A closure arrangement according to claim 1, wherein said closure member includes:

(i) a radially outer rim element (ii) a radially inner rim element hingedly attached to said outer rim element;

(iii) a central panel surrounded by and secured to said inner rim element.

8. A closure arrangement according to claim 7, wherein the heat activatable coating on the outer surface of said central panel forms a stronger bond with said closure member than the bond formed between the coating on the inner surface of said central panel and said container, so that when said inner rim element is moved away from said container the central portion of said membrane will separate from the remaining peripheral portion and will move away from said container member with said closure member.

* * * * *